US006573225B1

(12) United States Patent
Vidarsson et al.

(10) Patent No.: US 6,573,225 B1
(45) Date of Patent: Jun. 3, 2003

(54) AMIDE WAX LUBRICANT FOR WARM COMPACTION OF AN IRON-BASED POWDER COMPOSITION

(75) Inventors: Hilmar Vidarsson, Höganäs (SE); Sigurd Berg, Höganäs (SE)

(73) Assignee: Höganäs AB, Höganäs (SE)

( * ) Notice: Subject to any disclaimer, the term of this patent is extended or adjusted under 35 U.S.C. 154(b) by 0 days.

(21) Appl. No.: 10/049,857

(22) PCT Filed: Sep. 7, 2000

(86) PCT No.: PCT/SE00/01723

§ 371 (c)(1),
(2), (4) Date: Feb. 19, 2002

(87) PCT Pub. No.: WO01/19554

PCT Pub. Date: Mar. 22, 2001

(30) Foreign Application Priority Data

Sep. 10, 1999 (SE) ..... 9903244

(51) Int. Cl.[7] ..... B22F 1/00; C22C 33/02; C10M 133/16

(52) U.S. Cl. ..... 508/555; 75/252; 419/35; 419/36; 419/37

(58) Field of Search ..... 508/555; 75/252; 419/35, 36, 37

(56) References Cited

U.S. PATENT DOCUMENTS

| | | | | | |
|---|---|---|---|---|---|
| 3,954,460 | A | * | 5/1976 | Nickola | 75/208 |
| 4,955,798 | A | | 9/1990 | Musella | |
| 5,154,881 | A | | 10/1992 | Rutz et al. | |
| 5,429,792 | A | * | 7/1995 | Luk | 419/36 |
| 5,476,534 | A | * | 12/1995 | Ogura et al. | 75/252 |
| 5,744,433 | A | | 4/1998 | Storström et al. | |
| 5,754,936 | A | * | 5/1998 | Jansson | 419/10 |
| 6,355,208 | B1 | * | 3/2002 | Unami et al. | 419/11 |

FOREIGN PATENT DOCUMENTS

| | | |
|---|---|---|
| EP | 0 913 220 A1 | 9/1998 |
| EP | 0 853 994 A1 | 12/1998 |
| WO | WO 94/23868 A1 | 10/1994 |

* cited by examiner

*Primary Examiner*—Jacqueline V. Howard
(74) *Attorney, Agent, or Firm*—Burns, Doane, Swecker & Mathis, L.L.P.

(57) ABSTRACT

The invention concerns a metal powder composition for warm compaction comprising an iron-based powder and lubricant powder consisting of a polycarboxylic acid amide wax having a melting point peak in the range of 180° to 210° C.

14 Claims, No Drawings

AMIDE WAX LUBRICANT FOR WARM COMPACTION OF AN IRON-BASED POWDER COMPOSITION

This application is a 371 of PCT/SE00/01703 Sep. 7, 2000.

This invention relates to a lubricant for metallurgical powder compositions, as well as a metal-powder composition containing the lubricant. The invention further concerns a method for making sintered products by using the lubricant, as well as the use of the lubricant in a metal-powder composition in warm compaction.

In industry, the use of metal products manufactured by compacting and sintering metal-powder compositions is becoming increasingly widespread. A number of different products of varying shapes and thickness are being produced, and the quality requirements placed on these products are continuously raised. Thus, it is of paramount importance that the manufactured metal products have high and consistent density.

In metal compaction, different standard temperature ranges are used. Thus, cold pressing is predominantly used for compacting metal powder (the powder has room temperature). Use is also made of hot isostatic pressing (HIP) and warm pressing (compaction at temperatures between those used in cold pressing and HIP). Both cold pressing and warm pressing require the use of a lubricant.

Compaction at temperatures above room temperature has evident advantages, yielding a product of higher density and higher strength than compaction performed at lower pressures.

Most of the lubricants used in cold compaction cannot be used in high-temperature compaction, since they seem to be effective within a limited temperature range only. An ineffective lubricant considerably increases the wear of the compacting tool.

How much the tool is worn is influenced by various factors, such as the hardness of the material of the tool, the pressure applied, and the friction between the compact and the wall of the tool when the compact is ejected. This last factor is strongly linked to the lubricant used.

The ejection force is the force required for ejecting the compact from the tool. Since a high ejection force not only increases the wear of the compacting tool but also may damage the compact, this force should preferably be reduced.

However, the use of a lubricant may create problems in compaction, and it is therefore important that the lubricant is well suited to the type of compaction carried out.

In order to perform satisfactorily, the lubricant should, when subjected to pressure and shear forces, deform and flow between the particles of the powder composition. Some of the lubricant will be forced into the gap between the compact and the tool, thereby lubricating the walls of the compacting tool. By such lubrication of the walls of the compacting tool, the ejection force is reduced and thus, the wear of the die.

Another reason why the lubricant has to deform and exhibit flow when subject to pressure and shear forces during the compaction is that it would otherwise result in pores upon sintering of the compact. It is well known that large lubricant particles will result in large pores, which will have adverse effects on the dynamic strength properties of the product.

U.S. Pat. No. 5,154,881 (Rutz) discloses a method for making sintered products on the basis of a metal-powder composition containing an amide lubricant. Apart from the lubricant, which consists of the reaction product of a monocarboxylic acid, a dicarboxylic acid and a diamine, the composition contains iron-based powder. The amide lubricant thus consists of an amide product mixture chiefly made up of diamides, monoamides, bisamides and polyamides (cf column 4, lines 55–56). Especially preferred as a lubricant is ADVAWAX® 450 or PROMOLD® 450, which is an ethylenebisstearamide product and which is also the only lubricant tested. When industrially used this lubricant requires an accurate temperature control in order to perform satisfactorily. If the powder temperature exceeds the temperature set for the warm compaction, usually about 130° C. production problems may occur.

Furthermore, U.S. Pat. No. 4,955,798 (Musella) describes warm compaction more in general. According to this patent, lubricants generally used for cold compaction, e.g. zinc stearate, can be used for warm compaction as well. In practice, however, it has proved impossible to use zinc stearate or ethylenebisstearamide (commercially available as ACRAWAX®), which at present are the lubricants most frequently used for cold compaction, for warm compaction. The problems which arise are due to difficulties in filling the die in a satisfactory manner.

U.S. Pat. No. 5,744,433 (Storstrom) discloses a method for making sintered products on the basis of a metal-powder composition containing a lubricant, which is an oligomer of amide type having a weight-average molecular weight $M_w$ of 30,000 at the most and, preferably, at least 1,000 enabling the manufacture of compacted products having high green strength and high green density. The tested lubricants according to this patent may give problems such as cold welding and scratches may form on the ejected compacts. Also the risk of excessive tool wear cannot be eliminated.

The object of the present invention is to provide a lubricant which eliminates the disadvantages mentioned above. Particularly an object is to provide a lubricant less sensitive to temperature variations than the presently used lubricants.

The lubricant according to the invention essentially consists of an polycarboxylic acid amide. Most preferably this lubricant consists of Lanco wax (available from Lubrizol AG, Germany). In this context, the phrase "essentially consists of" means that at least 60% of the lubricant, preferably at least 75% and most preferably 90% by weight, is made up of the amide wax according to the invention.

The invention further concerns a metal-powder composition containing an iron-based powder and the above-mentioned lubricant, as well as a method for making sintered products. The method according to the invention comprises the steps of a) mixing an iron-based powder and a lubricant to a metal-powder composition,
b) preheating the metal-powder composition to a predetermined temperature,
c) compacting the metal-powder composition in a tool, and
d) sintering the compacted metal-powder composition at a temperature above 1050° C., use being made of a lubricant according to the invention.

The present invention further relates to the use of the lubricant according to the invention in a metallurgical powder composition in warm pressing.

Further, the lubricant according to the invention may have a melting point peak in the range of 180–210° C. and have a porous or nonporous structure.

The lubricant can make up 0.1–5% by weight of the metal-powder composition according to the invention. Preferably the amount of lubricant is less than 2 and most the amount varies between 0.2 and 0.8% by weight, based on the total amount of the metal-powder composition.

As used in the description and the appended claims, the expression "iron-based powder" encompasses powder essentially made up of pure iron; iron powder that has been prealloyed with other substances improving the strength, the hardening properties, the electromagnetic properties or other desirable properties of the end products; and particles of iron mixed with particles of such alloying elements (diffusion annealed mixture or purely mechanical mixture). Examples of alloying elements are copper, molybdenum, chromium, manganese, phosphorus, carbon in the form of graphite, and tungsten, which are used either separately or in combination, e.g. in the form of compounds ($Fe_3P$ and FeMo). Unexpectedly good results are obtained when the lubricants according to the invention are used in combination with iron-based powders having high compressability. Generally, such powders have a low carbon content, preferably below 0.04% by weight. Such powders include e.g. Distaloy AE, Astaloy Mo and ASC 100.29, all of which are commercially available from Höganäs AB, Sweden.

Apart from the iron-based powder and the lubricant according to the invention, the powder composition may contain one or more additives selected from the group consisting of binders, processing aids and hard phases. The binder may be added to the powder composition in accordance with the method described in U.S. Pat. No. 4,834,800 (which is hereby incorporated by reference)

The binder used in the metal-powder composition may consist of e.g. cellulose ester resins, hydroxyalkyl cellulose resins having 1–4 carbon atoms in the alkyl group, or thermoplastic phenolic resins.

The processing aids used in the metal-powder composition may consist of talc, forsterite, manganese sulphide, sulphur, molybdenum disulphide, boron nitride, tellurium, selenium, barium difluoride and calcium difluoride, which are used either separately or in combination.

The hard phases used in the metal-powder composition may consist of carbides of tungsten, vanadium, titanium, niobium, chromium, molybdenum, tantalum and zirconium, nitrides of aluminium, titanium, vanadium, molybdenum and chromium, $Al_2O_3$, $B_4C$, and various ceramic materials.

Apart from the lubricant according to the invention, the metal-powder composition may, if so desired, contain other lubricants, such as zinc stearate, lithium stearate and lubricants of amide wax type.

With the aid of conventional techniques, the iron-based powder and the lubricant particles are mixed to a substantially homogeneous powder composition.

Preferably, the lubricant according to the invention is added to the metal-powder composition in the form of solid particles. The average particle size of the lubricant may vary, but preferably is in the range of 3–150 $\mu$m.

If the particle size is too large, it becomes difficult for the lubricant to leave the pore structure of the metal-powder composition during compaction and the lubricant may then give rise to large pores after sintering, resulting in a compact showing impaired strength properties.

In warm pressing according to the invention, the metal-powder composition is advantageously preheated before being supplied to the heated compacting tool. In such preheating, it is of importance that the lubricant does not begin to soften or melt, which would make the powder composition difficult to handle when filling the compacting tool, resulting in a compact having a nonuniform density and poor reproducibility of part weights.

The steps of the warm compaction process are the following:

a) mixing an iron powder, a high-temperature lubricant and optionally an organic binder;
b) heating the mixture, preferably to a temperature of at least 120° C.;
c) transferring the heat-powder composition to a die, which is preheated to a temperature of preferably at least 120° C.; and compacting the composition at an elevated temperature of preferably at least 120° C.; and
d) sintering the compact at a temperature of at least 1050° C.

In step b) of the method, the powder composition is preferably preheated to a temperature of 5–50° C. below the melting point of the lubricant. Also, the tool is conveniently preheated to a temperature of 0–30° C. above the temperature of the preheated metal-powder composition.

Table 1 below demonstrates the relative insensitivity to temperature variations of the powder parameters flow and apparent density of powders including the lubricant according to the present invention (Lanco TPW-031, available from Lubrizol, Germany) in comparison with powders including Promold® 450 disclosed in the U.S. Pat. No. 5,154,881 in warm compaction. The iron powder used was Distaloy AE (marketed by Höganäs AB) mixed with 0.6% by weight of the selected lubricant and 0.3% by weight of graphite. The temperature of the powder varied from 120 to 150° C.

The table 2 demonstrates the calculated deviations in the flow rate and apparent density (AD) from the values obtained at 130° C. It is clearly demonstrated that the use of the lubricant according to the present invention provides a process that requires less strict temperature control than powders including the reference lubricant Promold 450.

TABLE 1

| | FLOW (S/50 g) | | AD (g/cm$^3$) | |
|---|---|---|---|---|
| TEMP (° C.) | PROMOLD | LANCO | PROMOLD | LANCO |
| 120 | 28.8 | 27.5 | 3.05 | 3.11 |
| 125 | 28.7 | 27.1 | 3.04 | 3.12 |
| 130 | 29.1 | 27.4 | 3.01 | 3.11 |
| 135 | 28.4 | 26.6 | 3.01 | 3.11 |
| 140 | 28.2 | 26.7 | 2.99 | 3.10 |
| 145 | 31.2 | 27.8 | 2.87 | 3.09 |
| 150 | 30.7 | 27.7 | 2.86 | 3.01 |

TABLE 2

| | Δ FLOW (s) | | Δ AD (g/cm$^3$) | |
|---|---|---|---|---|
| TEMP (° C.) | PROMOLD | LANCO | PROMOLD | LANCO |
| 120 | −0.3 | 0.1 | 0.04 | ±0.00 |
| 125 | −0.4 | −0.3 | 0.03 | 0.01 |
| 130 | ±0.0 | ±0.0 | ±0.00 | ±0.00 |
| 135 | −0.7 | −0.8 | ±0.00 | ±0.00 |
| 140 | −0.9 | −0.7 | −0.02 | −0.01 |
| 145 | 2.1 | 0.4 | −0.14 | −0.02 |
| 150 | 1.6 | 0.3 | −0.15 | −0.10 |

What is claimed is:

1. A metal powder composition for warm compaction comprising an iron-based powder and a lubricant powder consisting essentially of a polycarboxylic acid amide wax having a melting point peak in the range of 180° to 210° C.

2. A metal powder composition according to claim 1, which additionally contains one or more additives selected from the group consisting of binders, processing aids and hard phases.

3. A metal powder composition according to claim 1 wherein said amide is present in said composition in an amount of less than 5% by weight.

4. A metal powder composition according to claim 1, wherein said iron-based powder is compressible, and at least 80% by weight of said lubricant powder is made up of said amide wax.

5. A metal powder composition according to claim 2 wherein said amide is present in said composition in an amount of less than 5% by weight.

6. A metal powder according to claim 1 wherein said amide is present in said composition in an amount less than 2% by weight.

7. A metal powder according to claim 2 wherein said amide is present in said composition in an amount less than 2% by weight.

8. A metal powder according to claim 1 wherein said amide is present in said composition in an amount less than 1% by weight.

9. A metal powder according to claim 2 wherein said amide is present in said composition in an amount less than 1% by weight.

10. A metal powder composition according to claim 2, wherein said iron-based powder is compressible, and at least 80% by weight of said lubricant powder is made up of said amide wax.

11. A metal powder composition according to claim 3, wherein said iron-based powder is compressible, and at least 80% by weight of said lubricant powder is made up of said amide wax.

12. A metal powder composition according to claim 6, wherein said iron-based powder is compressible, and at least 80% by weight of said lubricant powder is made up of said amide wax.

13. A method for making sintered products, comprising the steps of a) mixing an iron-based powder and a lubricant to a metal-powder composition, b) preheating the powder composition to a predetermined temperature, c) compacting the powder composition in a preheated tool, and d) sintering the compacted powder composition at a temperature above 1050° C., characterised in that the lubricant essentially consists of a polycarboxylic acid amide having a melting point peak in the range of 180–210° C.

14. A method as claimed in claim 13, characterised in that the powder composition in step b) is preheated to a temperature of 5–50° C. below the melting point of the polycarboxylic acid amide having a melting point peak in the range of 180° to 210° C.

* * * * *